US007581598B2

(12) United States Patent
Radke et al.

(10) Patent No.: US 7,581,598 B2
(45) Date of Patent: Sep. 1, 2009

(54) BLADE MOTION REDUCTION

(75) Inventors: Daniel Dean Radke, Dubuque, IA (US); James Arthur Nagorcka, Tarrington Victoria (AU); Lyal Douglas Allen, Hamilton Victoria (AU); Lawrence William Bergquist, Dubuque, IA (US)

(73) Assignee: Deere & Company, Moline, IL (US)

( * ) Notice: Subject to any disclaimer, the term of this patent is extended or adjusted under 35 U.S.C. 154(b) by 719 days.

(21) Appl. No.: 11/286,734

(22) Filed: Nov. 23, 2005

(65) Prior Publication Data

US 2006/0123670 A1 Jun. 15, 2006

Related U.S. Application Data

(60) Provisional application No. 60/631,562, filed on Nov. 29, 2004.

(51) Int. Cl.
*E02F 3/76* (2006.01)
*B62D 55/065* (2006.01)

(52) U.S. Cl. ..... 172/819; 180/9.44

(58) Field of Classification Search ..... 37/366, 37/466, 403; 172/784, 789, 780, 447, 788, 172/793, 819, 828; 180/9.44, 6.64; 280/461.1, 280/400

See application file for complete search history.

(56) References Cited

U.S. PATENT DOCUMENTS

| | | | | |
|---|---|---|---|---|
| 3,763,938 | A | 10/1973 | Brodersen | 172/789 |
| 3,899,028 | A | 8/1975 | Morris et al. | 172/4.5 |
| 3,907,041 | A | 9/1975 | Manor | 172/780 |
| 3,974,699 | A | 8/1976 | Morris et al. | 73/432 |
| 3,986,563 | A | 10/1976 | Stubben | 172/793 |
| 4,053,017 | A | 10/1977 | Gill et al. | 172/4.5 |
| 4,061,194 | A | 12/1977 | McCanse | 172/447 |
| 4,088,236 | A | 5/1978 | Moore | 214/90 |
| 4,124,080 | A | 11/1978 | McCanse | 172/447 |
| 4,213,507 | A | 7/1980 | Horrer et al. | 172/784 |
| 4,340,126 | A | 7/1982 | Larson | 180/305 |
| 4,635,730 | A | 1/1987 | Larsson | 172/788 |
| 4,696,350 | A | 9/1987 | Ruhter et al. | 172/793 |
| 4,807,461 | A | 2/1989 | Brimeyer et al. | 172/793 |
| 5,074,061 | A | 12/1991 | Thompson | 37/129 |
| 5,549,412 | A | 8/1996 | Malone | 404/84.1 |
| 5,632,350 | A * | 5/1997 | Gauvin | 180/9.44 |
| 5,762,446 | A | 6/1998 | Manatt et al. | 404/75 |
| 5,775,438 | A | 7/1998 | Confoey et al. | 172/831 |
| 5,921,706 | A | 7/1999 | Manatt et al. | 404/72 |
| 6,322,287 | B1 | 11/2001 | Yelton | 404/118 |
| 6,382,873 | B1 | 5/2002 | Mulders et al. | 404/128 |
| 6,691,795 | B2 | 2/2004 | L'Abbe | 172/787 |
| 6,810,975 | B2 * | 11/2004 | Nagorcka et al. | 180/9.5 |
| 7,451,840 | B2 * | 11/2008 | Radke et al. | 180/9.44 |
| 2002/0162669 | A1 | 11/2002 | L'abbe | 172/787 |

* cited by examiner

*Primary Examiner*—Robert E Pezzuto

(57) ABSTRACT

An articulated loader has an articulated chassis and corresponding A-frames. The points of the A-frames face each other. The articulated chassis includes a front portion and a rear portion. Likewise, there is a front or first A-frame and a rear or second A-frame. The A-frames are connected to the overall chassis at points close to but offset from the point of vehicle articulation via ball joints and via hydraulic suspension cylinders toward the wider portions of the "A"s. The tracks are independently suspended. The C-frame and blade are mounted to the first A-frame while the controlling cylinders are mounted to the front chassis portion. This allows the blade to follow the tracks or ground and yet stabilize its motion.

6 Claims, 5 Drawing Sheets

BLADE MOTION REDUCTION

This document claims priority based on U.S. provisional application Ser. No. 60/631,562, filed Nov. 29, 2004, and entitled BLADE MOTION REDUCTION, under 35 U.S.C. 119(e).

FIELD OF THE INVENTION

This applies to an articulated crawler dozer with four independent tracks and a suspension system. In this configuration, the track systems are mounted such that they can move in a way that they can follow the contour of the ground.

BACKGROUND OF THE INVENTION

Conventional construction vehicles (dozers, loaders, backhoes, skid steers, graders, etc) do not usually have cushioning suspension systems but are, at most, equipped with pneumatic tires. The consequence is that the machine ride can be very harsh dependant upon the operating conditions of the machine.

Traditionally blade equipped vehicles such as crawlers or graders are structurally rigid. This is desirable to avoid undesirable vertical blade movements under changing soil conditions. The cutting edge of the blade is, typically, angled back at the top so that it will shave off the material when elevated material is contacted. A consequence of this characteristic is that a vertical force is generated on the blade cutting edge when hard soil conditions are encountered. If the machine is not sufficiently rigid, the blade will lower and dig into the ground under these conditions. When soft soil is encountered and the vertical force reduced, the blade will tend to rise to a higher elevation.

An analogy can be made to a plane that is used in woodworking. A rigid plane would tend to shave off high regions without gouging, and move over low regions without any affect to the material. A relatively flexible plane would tend to gouge the high regions of the wood surface.

The addition of suspension to construction vehicles such as, for example, crawlers and graders, can create a situation that is counter to the desired operating conditions stated above.

SUMMARY OF THE INVENTION

The invention includes a front lower frame and a rear lower frame as well as an articulated chassis having a front portion and a rear portion. The front and rear lower frames are pivotally attached to the articulated chassis. A C-frame for the blade is pivotally attached to the first lower frame and operatively attached via hydraulic cylinders to the front portion of the chassis. Additionally, the blade is directly connected to hydraulic cylinders that are attached to the C-frame. Such an arrangement allows the blade to follow the front tracks of a four track vehicle and not be unduly affected by chassis motion enabled by the suspension system.

DESCRIPTION OF THE ILLUSTRATED EMBODIMENT

The exemplary embodiment of the invention described herein is applied to a crawler dozer with 4 independent tracks. In this configuration, the tracks are mounted such that they can move in a way that they can follow the contour of the ground. Each of the tracks pivots about a drive wheel.

Figure 1:
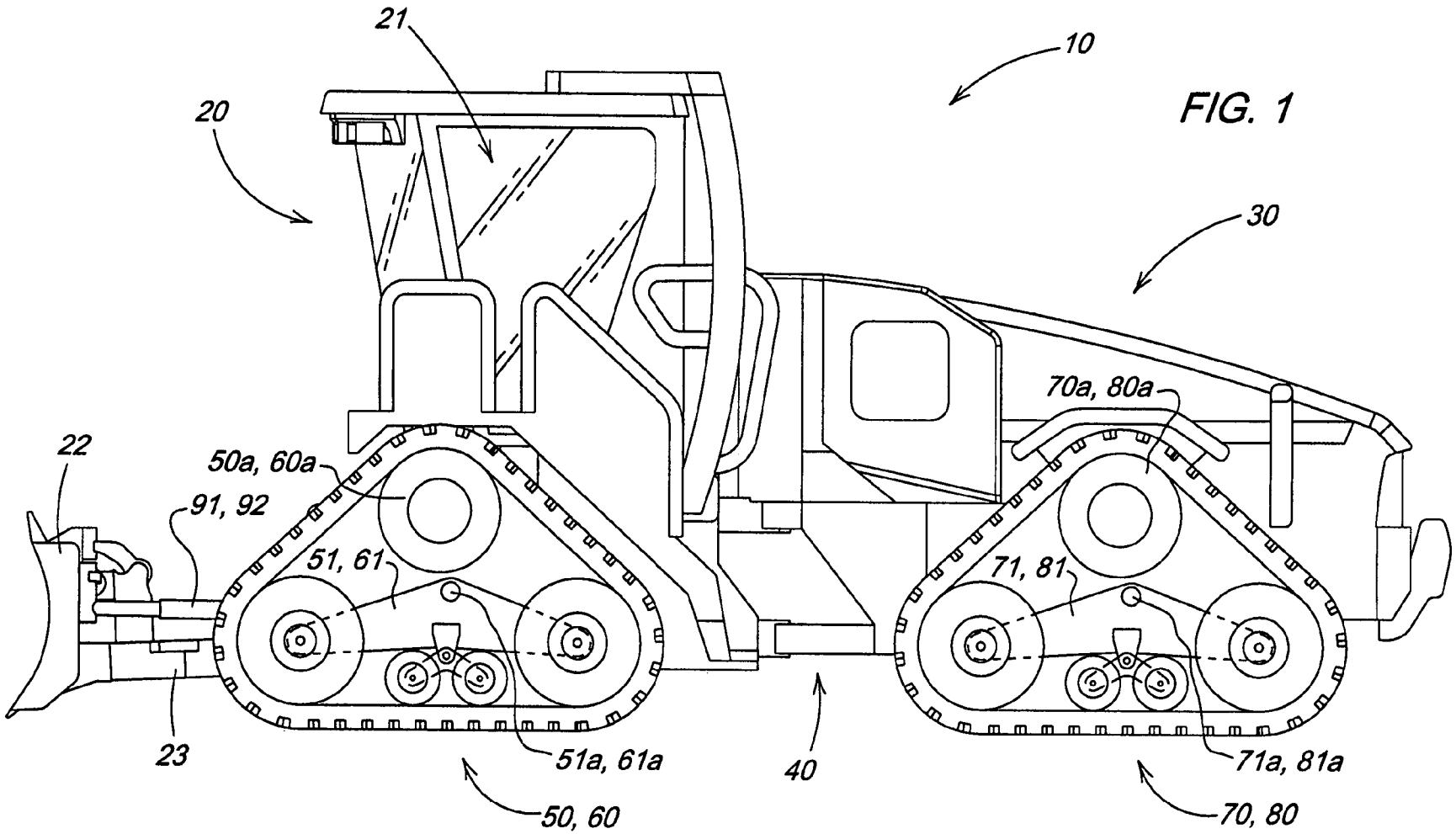
FIG. 1 is a side view of a work vehicle in which the invention may be used.

FIG. 1 illustrate a vehicle in which the invention may be used. The particular vehicle illustrated in FIG. 1 is a four track articulated dozer 10 having a front portion 20 a rear portion 30; an articulation mechanism 40 between the front portion 20 and the rear portion 30; first and second track systems 50, 60; and third and fourth track systems 70, 80. The front portion 20 includes a blade 22 and a blade mounting frame 23 as well as an operator cab 21.

Figure 3:
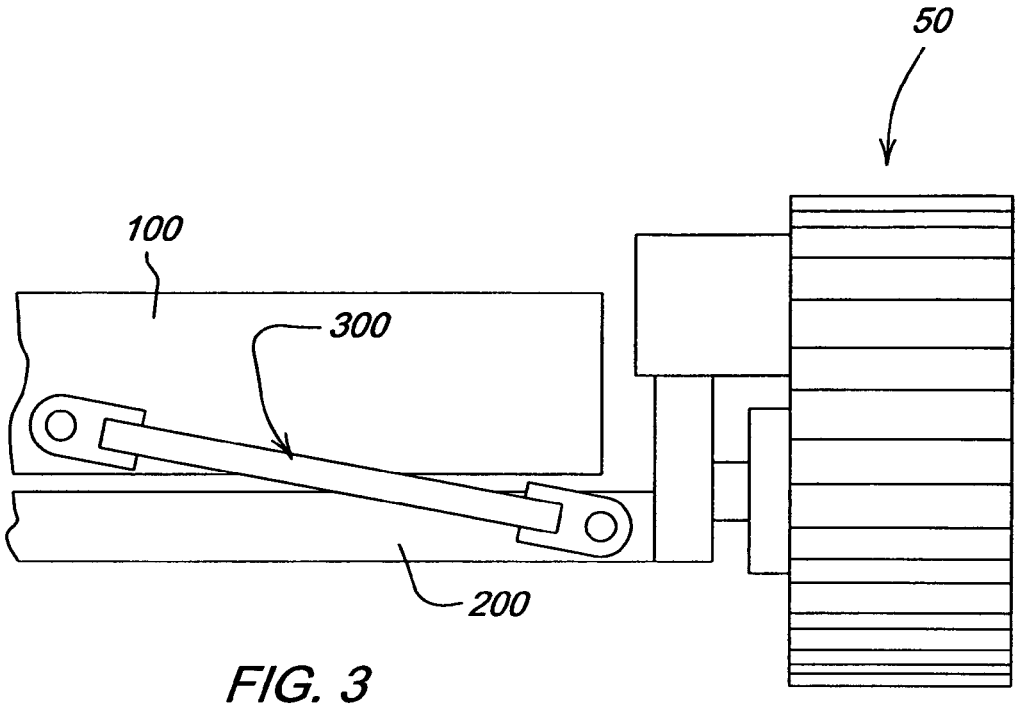
FIG. 3 is a front view of a front portion of the chassis and a first A-frame connected by a pan hard rod.
Figure 4:
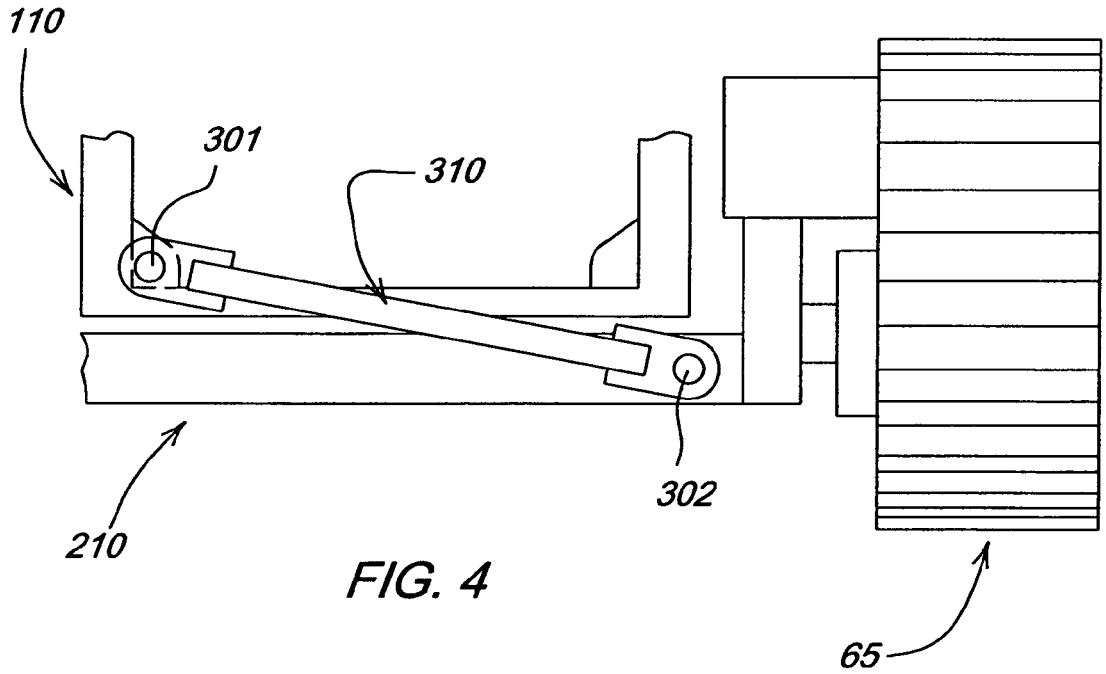
FIG. 4 is a rear view of a rear portion of the chassis and a second A-frame connected by a pan hard rod.
Figure 5:
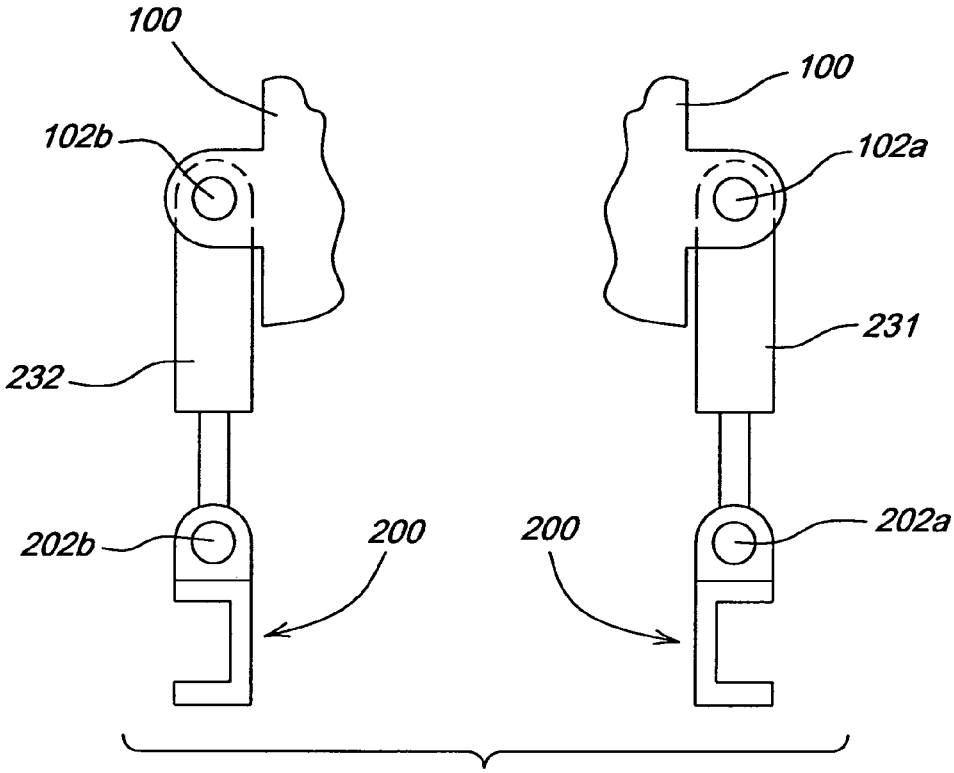
FIG. 5 is a front view of the front portion of the chassis and the first A-frame connected by two suspension cylinders.
Figure 6:
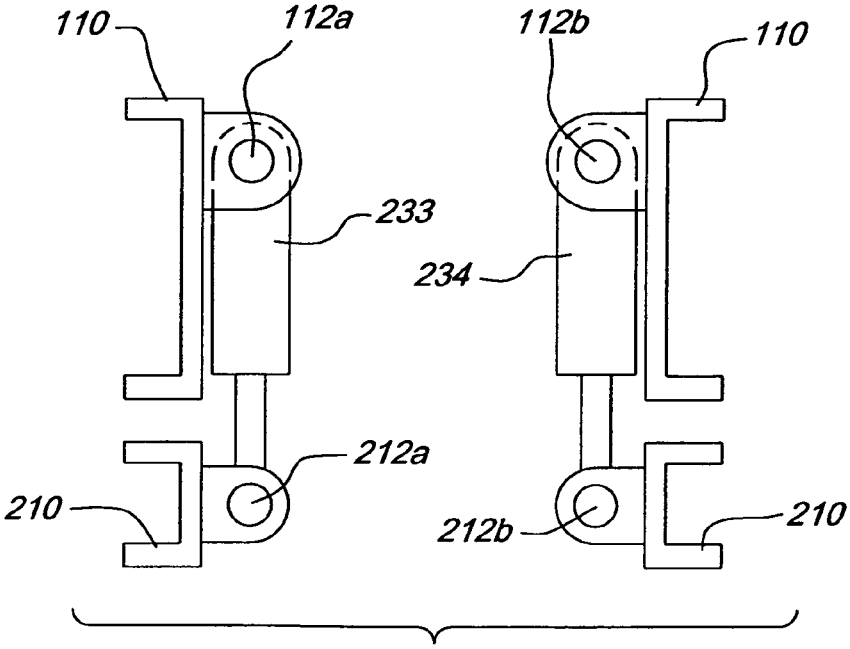
FIG. 6 is a rear view of a rear portion of the chassis and a second A-frame connected by two suspension cylinders.
Figure 7:
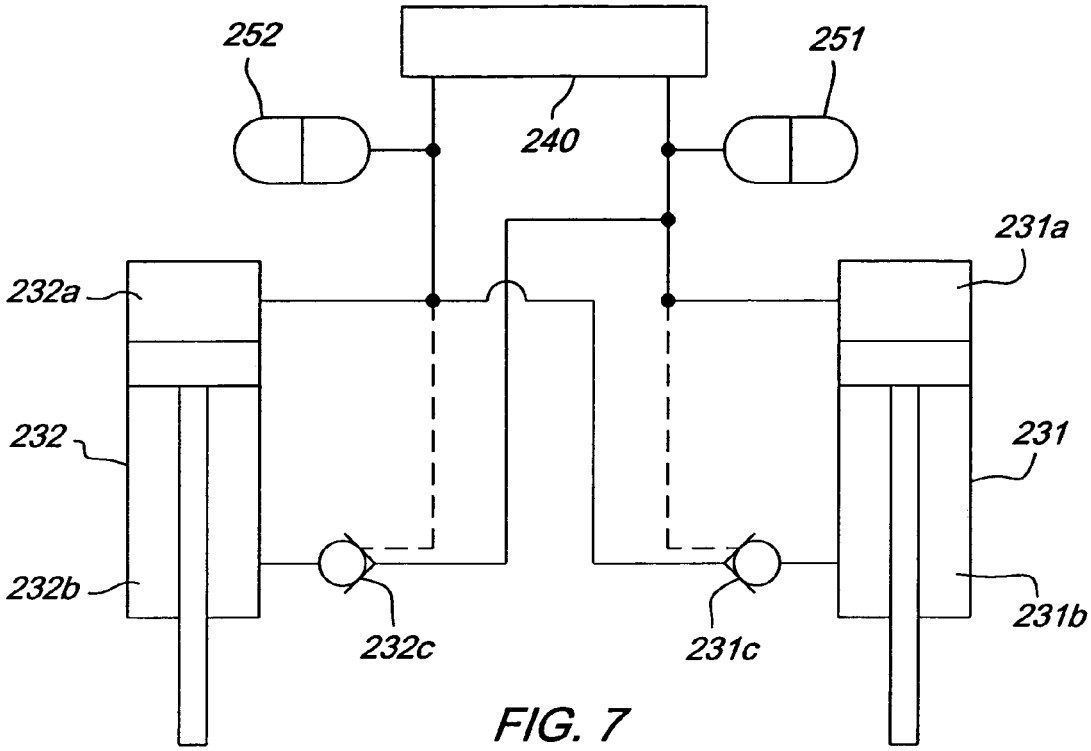
FIG. 7 is an exemplary schematic of the cylinders illustrated in FIG. 5.
Figure 8:
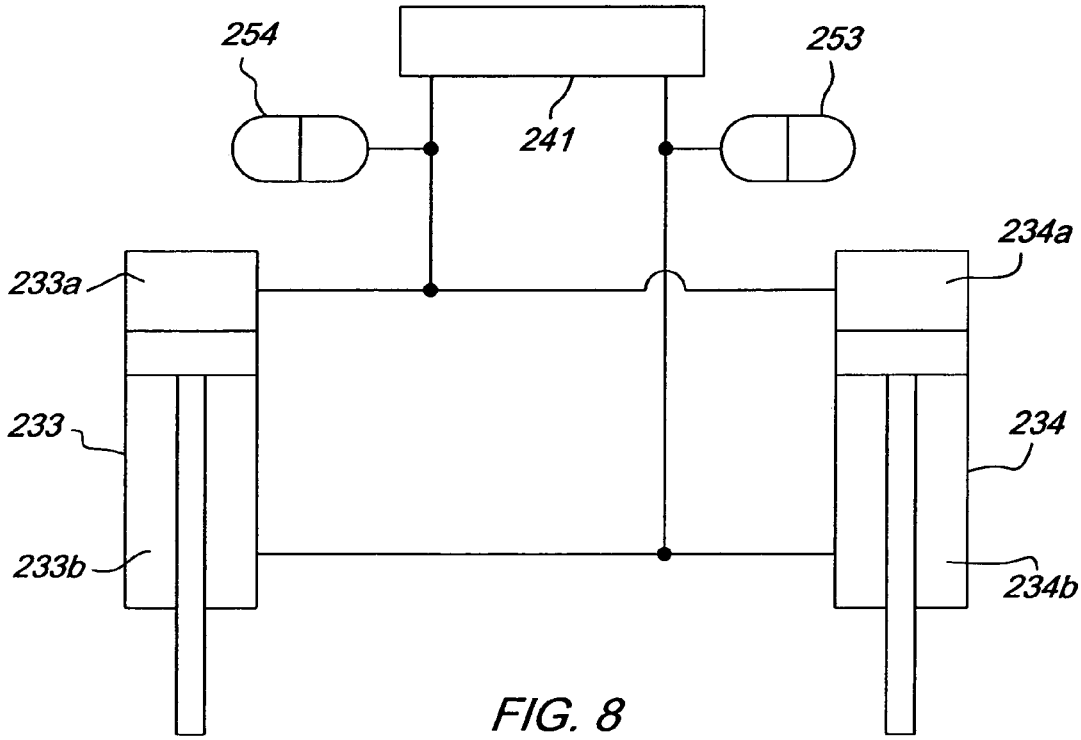
FIG. 8 is an exemplary schematic of the cylinders illustrated in FIG. 6.

The first and second track systems 50, 60 are mounted on an A-frame structure or a first A-frame 200 that is pivotally connected to both the first and second track frames or rocker arms 51,61. The first A-frame 200 is connected to a front chassis portion 100 primarily at the top of the "A", i.e., a narrower portion of the first A-frame 200, with a first spherical ball joint 101. This first spherical ball joint 101 is located forward of the articulation joint 40. Laterally the first A-frame 200 is connected to the front chassis portion 100 with a first linkage (first pan-hard rod) 300 (see FIG. 3) to keep the position of the first A-frame 200 approximately centered under the front chassis portion 100. The front chassis portion 100 is vertically connected to the first A-frame by a first suspension cylinder 231 and a second suspension cylinder 232. The first and second suspension cylinders are, respectively, attached to first and second hydraulic accumulators 251, 252. A mechanism senses the position of the first A-frame 200 relative to the front chassis portion 100 at each cylinder location, and controls the vehicle height, via hydraulic balancing circuit 240 by adding or removing hydraulic fluid from the first and second suspension cylinders on a continuous basis. These cylinders primarily support the vehicle weight.

It is also desired to control vehicle roll position at this front axle 203. To accomplish this, a head end of the first cylinder 231*a* is hydraulically connected to a rod end of the second cylinder 232*b*. Conversely a head end of the second cylinder 232*a* is hydraulically connected to a rod end of the first cylinder 231*b*. This methodology reduces the effective cylinder area to be equal to the rod area of the cylinder. This creates a higher pressure in the system which is desirous for improved suspension control.

Figure 2:
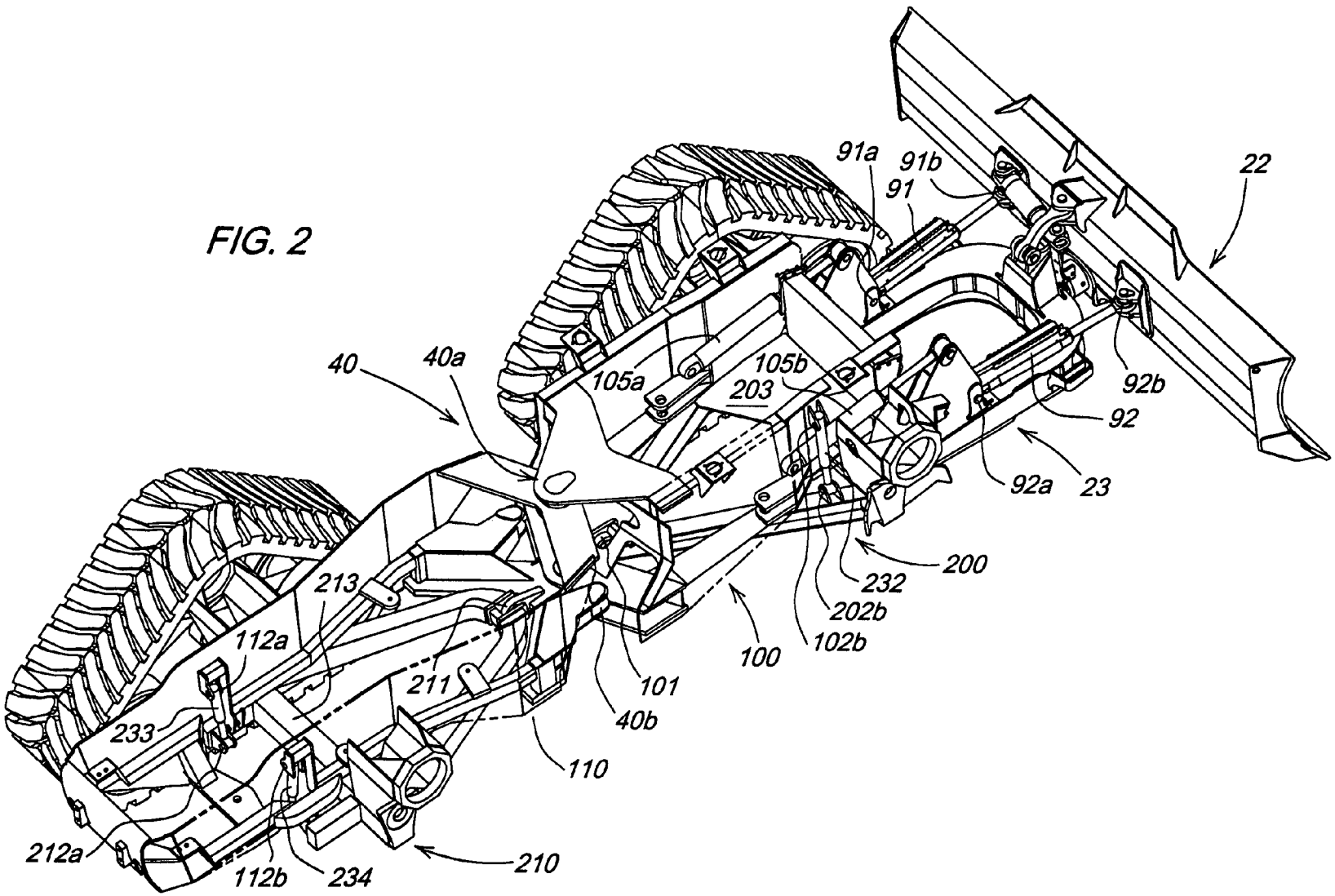
FIG. 2 is an elevated oblique view of an articulated chassis and two A-frames of the vehicle illustrated in FIG. 1.

As illustrated in FIG. 2, the first and second suspension cylinders 231, 232 are attached to the first A-frame 200 at a point behind the respective track frame pivots 51, 61 so that they operate at an increased pressure level. This helps contribute to the roll stability mentioned above by increasing the pressure proportionally.

The third and fourth track systems 71, 81 are mounted on a second A-frame structure 210 that is pivotally connected to both the left and right track frames, i.e., rocker arms 71, 81. The second A-frame 210 is connected a rear chassis portion 210 primarily at the top of the "A", i.e., at a narrower portion of the second A-frame 210, with a second ball joint 211. The second ball joint 211 is located rearwards of the articulation joint 40. Laterally the second A-frame 210 is connected to the rear chassis portion 110 with a linkage (pan-hard rod) 310 to keep the second A-frame 210 approximately centered under the rear chassis portion 110. The rear chassis portion 110 is vertically connected to the second A-frame 210 by third and fourth suspension cylinders 233,234, one on the left and one the right side of the vehicle. These suspension cylinders 233, 234 are hydraulically connected together and are attached to respective hydraulic accumulators 253, 254. A mechanism senses the position of the A-frame relative to the vehicle frame at a point midway between the cylinders indicating the average location, and controls the vehicle height, via hydraulic balancing circuit 241, by adding or removing hydraulic fluid from the cylinder system on a continuous basis.

It is desired to have the rear axle oscillate to ensure all 4 tracks maintain ground contact at all times. This is done by connecting the head end of the right and left cylinders together to allow oil to flow from one to the other as needed. The rod ends of the left and right cylinders are, likewise, connected together.

The third and fourth cylinders 233, 234 are attached to the second A-frame 210 at respective locations behind the rocker arm pivots 71*a*, 81*a* so that they operate at a reduced pressure level. This lowers the pressure of the system for a smoother ride.

First and second balancing circuits 240, 241 are hydraulic circuits that maintain the nominal distances between: the front chassis portion 100 and the front A-frame 200; and the rear chassis portion 110 and the rear A-frame 210.

The blade mounting structure, referred to as the C-Frame 23, is operatively attached to the first A-Frame 200. This ensures the blade level (right to left with respect to the operator) will be consistent with the tracks and not affected by vehicle chassis motion enabled by the suspension system motion.

The blade mounting cylinders 105*a*, 105*b* are mounted to the front chassis portion 100 and the blade mounting C-Frame 23. The location and orientation of these cylinders and their attachment points are selected such that blade vertical movement is minimized or eliminated when suspension movement occurs.

Mounting the blade C-frame 23 and controlling cylinders 105*a*, 105*b* to the first A-frame 200 solely would produce an amplified blade motion relative to suspension motion.

Mounting the blade C-frame 23 and controlling cylinders 105*a*, 105*b* to the front chassis portion 100 solely would likewise produce an amplified blade motion. Additionally any vertical loading at one end of the blade would generate rolling force in the chassis which would need to be reacted by the suspension system.

The ball joints 101 and 211 are close to equidistant from the articulation joint 40 which helps to reduce vehicular distortions due to non-equal moments.

The combination specified first creates the maximum blade roll rigidity while minimizing undesired blade vertical movement due to suspension motion.

Having described the illustrated embodiment, it will become apparent that various modifications can be made without departing from the scope of the invention as defined in the accompanying claims.

The invention claimed is:

1. An articulated dozer, comprising:

a first chassis portion;

a second chassis portion;

a first A-frame;

a second A-frame;

a C-frame having a first side and a second side;

a first controlling cylinder;

a second controlling cylinder;

a grader blade having a first blade side and a second blade side, the first A-frame attached to the first chassis portion such that lateral movements of the grader blade relative to the first A-frame are constrained and vertical movements of the blade relative to the first A-frame are constrained, the blade being operatively attached to the C-frame, the C-frame being operatively attached to the A-frame, the first controlling cylinder connecting the first blade side to the first chassis portion, the second controlling cylinder connecting the second blade side to the first chassis portion.

2. The articulated dozer of claim 1 further comprising an articulation joint, wherein the first chassis portion is connected to the second chassis portion via the articulation joint.

3. The articulated dozer of claim 2, further comprising a joint, wherein the first A-frame is rotationally connected to the first chassis portion, via the joint, at a location in proximity to the articulation joint.

4. The articulated dozer of claim 3, wherein the joint comprises a first ball joint.

5. The articulated dozer of claim 3, further comprising a second ball joint, wherein the second A-frame is rotationally connected to the second chassis portion via the second ball joint.

6. The articulated dozer of claim 1, wherein a majority a load from the blade is supported by the first A-frame and the second A-frame.

* * * * *